United States Patent [19]

Molodecki

[11] Patent Number: 4,631,877

[45] Date of Patent: Dec. 30, 1986

[54] COLLAPSIBLE HUT

[76] Inventor: Edward J. Molodecki, 5 Foster Ave., Smith Falls, Ontario, Canada, K7A 1J9

[21] Appl. No.: 773,045

[22] Filed: Sep. 6, 1985

[30] Foreign Application Priority Data

May 30, 1985 [CA] Canada ..... 482828

[51] Int. Cl.[4] ..... E04B 1/34

[52] U.S. Cl. ..... 52/70; 52/143; 280/8; 280/30; 296/10; 267/36 R

[58] Field of Search ..... 280/10, 8, 125, 14, 280/264, 30; 267/36 R; 52/143, 69, 68, 70, 64; 296/10

[56] References Cited

U.S. PATENT DOCUMENTS

| | | | |
|---|---|---|---|
| 390,661 | 10/1888 | Forsyth | 280/8 |
| 1,971,977 | 8/1934 | Erickson | 52/69 |
| 3,283,452 | 11/1966 | Hayes | 52/143 |
| 3,707,811 | 1/1973 | Hampson | 52/143 |
| 3,792,558 | 2/1974 | Berce | 52/143 |
| 4,438,940 | 3/1984 | Hunt | 280/125 |
| 4,467,572 | 8/1984 | Somers | 52/143 |

FOREIGN PATENT DOCUMENTS

| | | | |
|---|---|---|---|
| 31898 | 7/1961 | Finland | 52/69 |
| 926222 | 5/1963 | United Kingdom | 52/69 |

*Primary Examiner*—Henry E. Raduazo

*Attorney, Agent, or Firm*—Dennison, Meserole, Pollack & Scheiner

[57] ABSTRACT

A collapsible hut useful, in particular, for ice fishing comprises wall and roof panels which can be releasably secured together in a first assembly to form the hut and in a second assembly to form parts of a container. Skis and/or wheels are provided for supporting the container for travel over the ground, so that the hut can readily be transported to remote locations. When the hut is collapsed, the panels can be packed flat to form a very compact storage package.

12 Claims, 13 Drawing Figures

37
16b
37
16a
37
12a
23
12c
23
12b
38
22b
38
20a 23
18d
23
18b
18c
16b
16a
18a
24
24
12a
12b
32

14a
14b
16b
16a
37
37
12a
12b
34
32

20a
12a
12b
23
23

COLLAPSIBLE HUT

FIELD OF THE INVENTION

The present invention relates to a collapsible hut and is useful in particular, but not exclusively, for ice fishing huts.

DESCRIPTION OF THE PRIOR ART

Conventionally, ice fishing huts are made of sheets of plywood which are permanently secured together, so that the huts are not collapsible. Consequently, when the huts are to be employed in remote locations, they must be constructed at those locations and either taken apart when spring approaches or moved to a nearby storage position on a lakeshore or riverbank.

There therefore exists a real need for a hut which is suitable for ice fishing and which can be readily transported to and from remote ice fishing locations.

For this purpose, it has previously been proposed to mount a non-collapsible ice fishing hut on skis, so that the hut can be towed by a skidoo or other suitable vehicle to and from the location in which it is intended to be used. However, this type of hut has the disadvantage that, obviously, it is relatively bulky and that, therefore, the locations to which it can be taken are restricted to those to which access can be obtained by a path of travel which is sufficiently wide and unobstructed by tree branches and the like to allow the assembled hut to be drawn along such path of travel.

It has also previously been proposed to construct a collapsible hut having a floor and opposite end walls made of plywood and a roof and side walls made of a canvas tarpaulin secured to the end walls and supported by a ridge pole extending between the tops of the end walls, the entire hut being collapsible and being transportable, in its collapsed condition, on toboggan runners. However, this prior proposal has the disadvantage that many of the users of such huts prefer to avoid the use of canvas rooves and walls, in favour of more wind-resistant, rigid materials, such as plywood.

Furthermore, when a hut is being transported to and from a remote location, it is usually desired to simultaneously transport other equipment, for example, heaters, fishing equipment, etc. together with the hut, and there is therefore a need for a container for carrying such equipment.

BRIEF SUMMARY OF THE INVENTION

It is, accordingly, an object of the present invention to provide a novel and improved collapsible hut which is made of components which can be reassembled to form a container which can be drawn along the ground.

According to the present invention, there is provided a collapsible hut comprising a plurality of sheet-shaped wall and roof components, means for releasably securing the sheet-shaped wall and roof components together in a first assembly as parts of a hut, means for releasably securing the sheet-shaped wall and roof components together in a second assembly as parts of a container, and ground engagement means for supporting the container for travel over the ground.

Preferably, the ground engagement means are releasably securable to the wall components for supporting the first assembly on the ground, so that the erected hut can be supported on the ground engagement means and moved along the ground on these means if required.

The ground engagement means may comprise a pair of skis, means for securing the skis to the side wall components at a pair of locations spaced apart longitudinally of each of the skis and means for releasably and rotatably securing a pair of wheels to the skis between the pairs of locations, whereby the wheels are engageable with the ground and the skis act as suspension springs.

BRIEF DESCRIPTION OF THE DRAWINGS

The invention will be more readily understood from the following description of a preferred embodiment thereof given by way of example, with reference to the accompanying drawings, in which.

Figures 1, 2, 3:
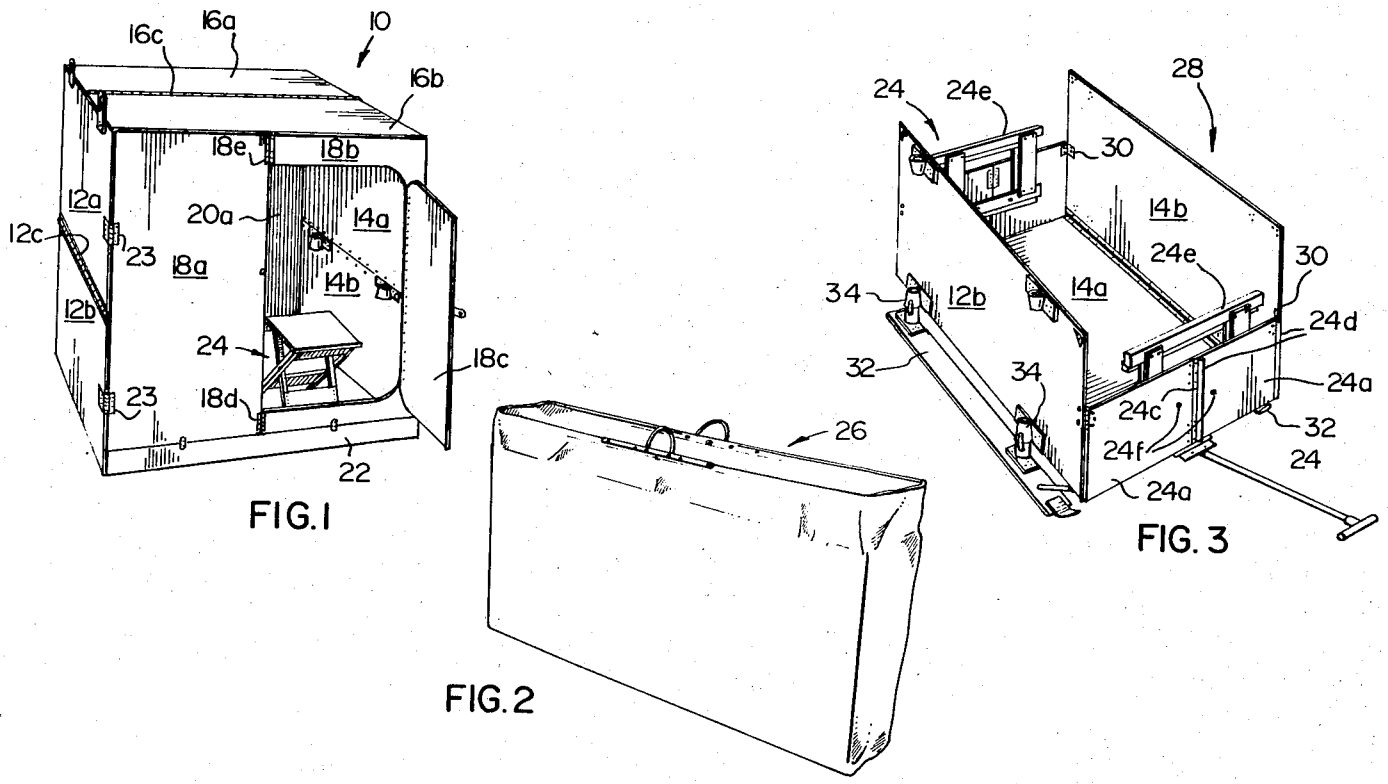
FIG. 1 shows a view in perspective of an erected ice fishing hut embodying the present invention.
FIG. 2 shows a canvas bag for containing the components of the hut of FIG. 1.
FIG. 3 shows a view in perspective of an open-topped transport container assembled from the components of the hut of FIG. 1.
Figure 7:
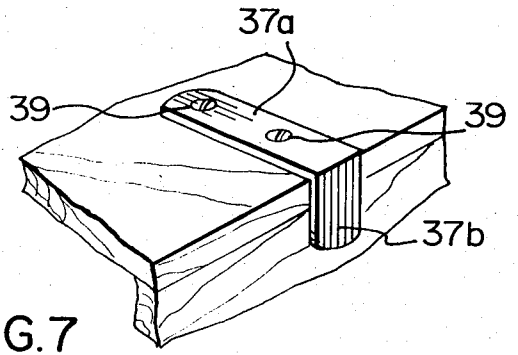
Figure 8:
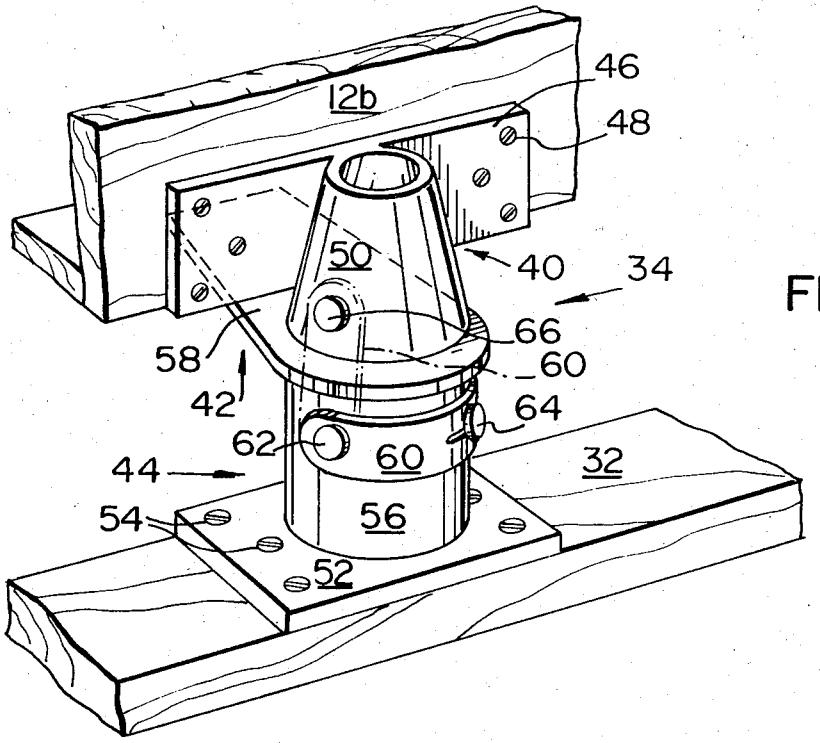

FIGS. **6*b* to 6*e* show successive stages in the assembly of the hut of FIG. 1**;

FIG. 7 shows a view in perspective of a clip;

FIG. 8 shows a view in perspective of a connector; and

Figure 9:
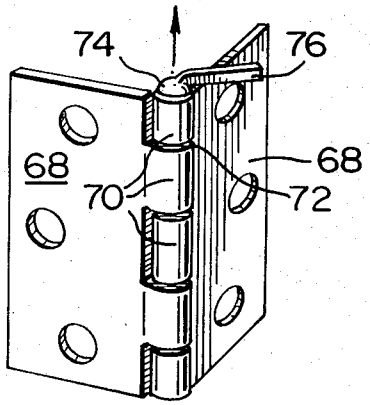

FIG. 9 shows a view in perspective of another connector.

DESCRIPTION OF THE PREFERRED EMBODIMENT

In FIG. 1, there is shown an ice-fishing hut indicated generally by reference numeral 10, which comprises opposite side walls formed by sheets or panels **12*a*, 12*b* and 14*a*, 14*b*; a roof formed by two sheets or panels of plywood 16*a* and 16*b*; a front wall formed by two sheets of plywood 18*a* and 18*b* and a rear wall which is likewise formed of two sheets or panels of plywood, one of which is indicated by reference numeral 20*a***.

It is to be noted that the grain of the outer plies of the wall and roof panels which is shown by shading lines in FIG. 1, is oriented as shown by these shade lines so as to strengthen the erected hut 10.

The panel **18*b* is cut to provide a door 18*c*, which is pivotally secured by an elongate hinge 18*d* (FIG. 6*e*) to the remainder of the panel 18*b*, which forms a surround around the door 18*c* and which is pivotally secured by hinges 18*e* and 18*d* to the panel 18*a***.

The panels **12*a* and 12*b* are hingedly connected by a hinge 12*c*, which connects adjacent horizontal longitudinal edges of the panels 12*a* and 12*b*, and the panels 16*a* and 16*b* are likewise pivotally connected by an elongate hinge 16*c* connected to adjacent longitudinal edges of the panels 16*a* and 16*b***.

Further hinges **14*c* and 20*c* hingedly connect together the panels 14*a* and 14*b* 20*a* and 20*b* forming the rear wall of the hut 10**.

The front wall of the hut 10 further comprises, at the bottom thereof, a horizontally elongate filler strip 22, which closes a gap between the bottom edges of the panels **18*a* and 18*b*** and the ground.

The panels and hinges thus form wall and roof components which, when the hut is assembled as shown in FIG. 1, are arranged so that the two panels of each wall of the hut and the two panels of the hut roof are held in respective coplanar arrays by connection of their end edges to a longitudinal edge of one of the panels of an adjacent wall or of the roof. For example, the end edges of the panels 12*a* and 12*b* of one side wall of the hut are connected to the longitudinal edges of the panels 18*a* and 20*b*, which hold the panels 12*a* and 12*b* in vertical coplanar relationship. Likewise, the end edges of the roof panels 16*a* and 16*b* are held in horizontal coplanar array by the longitudinal edges of the panels 12*a* and 14*a*.

FIG. 1 also shows, within the hut 10, one of a pair of collapsible stools which is indicated generally by reference numeral 24.

The walls and the roof of the hut 10 are secured together by means of readily releasable connectors, of which two are indicated in FIG. 1 by reference numeral 23.

When these connectors are released, the walls and roof can be separated from one another. By means of the hinges 12*c*, etc., the pairs of panels forming the walls and roof can be folded onto one another and stacked, so that they can then be inserted into the canvas bag shown in FIG. 2 and indicated generally by reference numeral 26. When thus accommodated in the bag 26, the components of the hut 10 are in an extremely compact condition for storage or for transportation in a truck, a trunk of a car, an aeroplane, a boat or other vehicle.

Referring now to FIG. 3 of the drawings, the opposite side walls of the hut 10 may be partially folded and connected to one another and to the two stools 24 to form an open-topped transportation container which is indicated generally by reference numeral 28 in FIG. 3.

More particularly, the panel 12*a* can be pivoted so that it extends horizontally from the panel 12*b* with the latter vertical, the panel 12*a* then forming the bottom or floor of the container. The opposite side wall is similarly folded, so that the panel 14*a* overlies the panel 12*a* and the panel 14*b* extends vertically at a spacing from and parallel to the panel 12*b* so that the panels 12*b* and 14*b* form opposite sidewalls of the container.

By means of connectors, of which two are indicated by reference numeral 30 in FIG. 3, the stools 24 are connected between the two panels 12*a*, 14*a* to form the front and rear walls of the container 28, as described in greater detail below.

A pair of skis 32 are then secured by connectors 34 to opposite sides of the container 24 for supporting the latter for travel over snow and ice.

The panels forming the roof and the front and rear walls of the hut 10 can be folded and stacked on the panel 14*b* in the container 28.

The container 28 as shown in FIG. 3, supported on skis 32, can be towed behind a skidoo for transportation to and from a remote location, e.g. over a snow covered trail leading to a frozen lake, and is obviously suitable for carrying further equipment within the container, for example, heaters, fishing tackle, and the like. Also, the container 28 can be employed for transporting people or as a windbreak for people sitting within the container 28 while it is stationary.

It may also be desirable to be able to transport the hut into remote locations along paths which are not snow covered.

Figure 4:
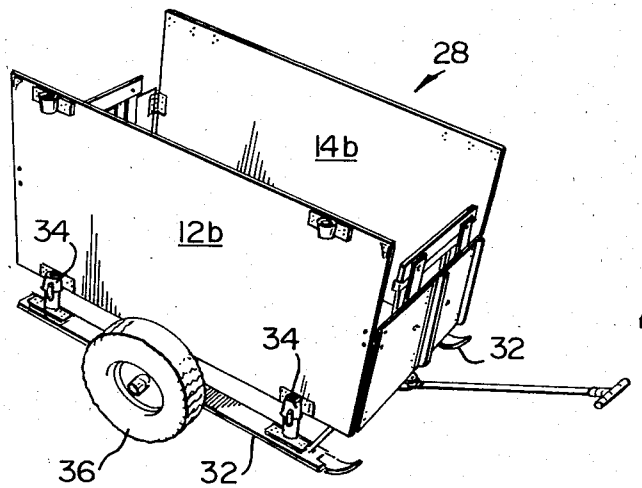
FIG. 4 shows a view in perspective of the container of FIG. 3, with wheels and a tow bar added.

For this purpose, a pair of wheels, of which only one is shown and indicated by reference numeral 36 in FIG. 4, can be rotatably secured to the skis 32, at locations between the longitudinally spaced connectors 34, for supporting the container 28 on the ground. This arrangement makes use of the resilience of the skis 32, which thus act as suspension springs for suspending the weight of the container 38 from the wheels 36.

The erection of the hut 10 is illustrated in FIGS. 6*b* to 6*e*.

Figure 6:
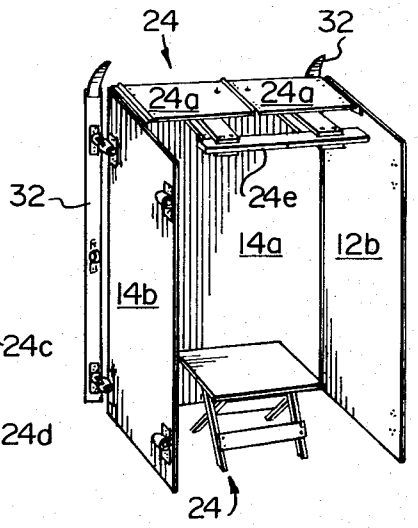
FIG. 6 shows a view in perspective of parts of the hut of FIG. 1 erected as a wind shield.
Figures 6B, 6C, 6D, 6E:
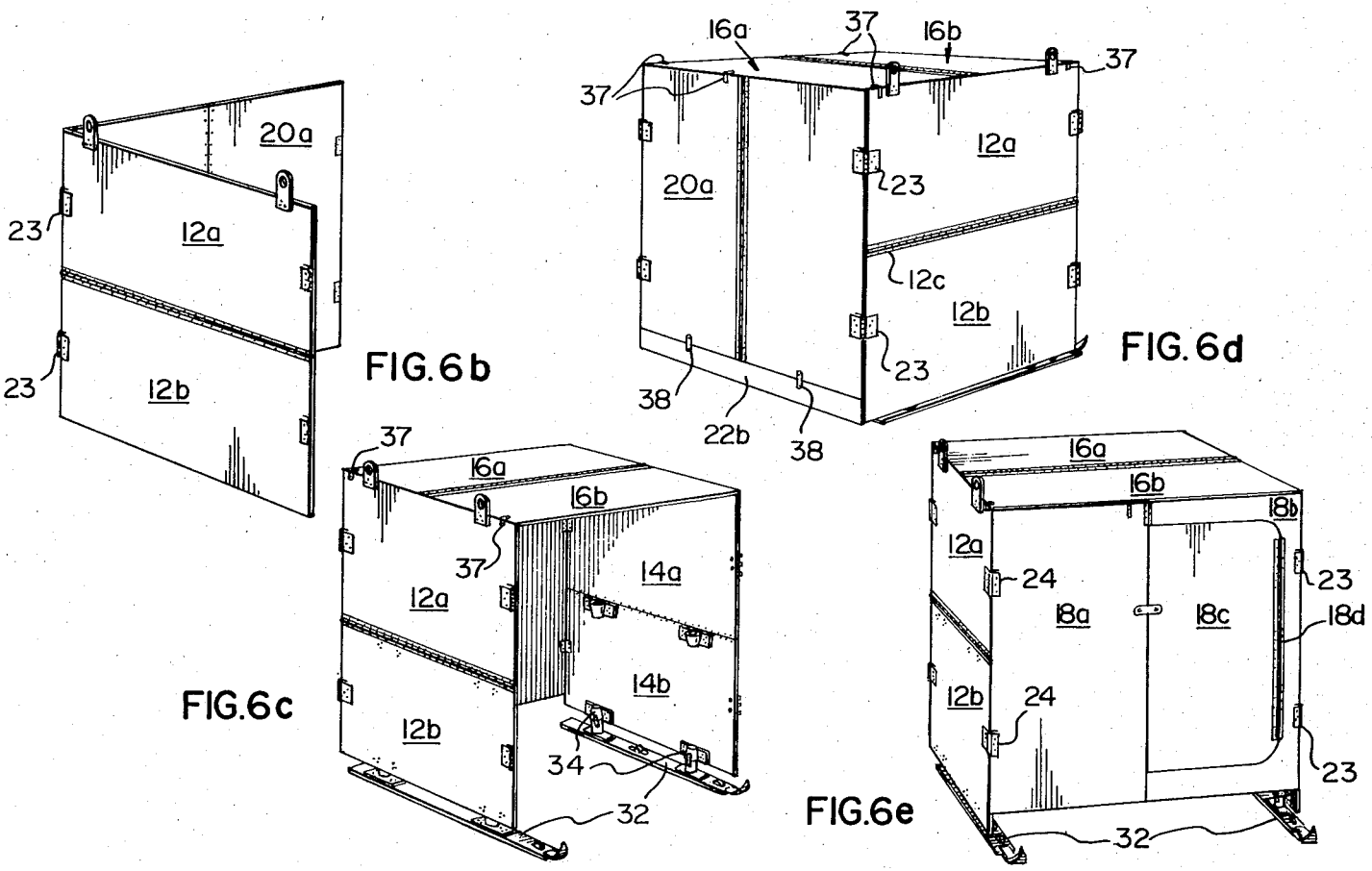

As shown in FIG. 6*b*, the first stage in the erection of the hut is the connection of the side wall, formed by the panels 12*a* and 12*b*, by means of two of the connectors 24 to one of the two panels forming the rear wall of the hut.

As shown in FIG. 6*b*, the side and rear walls are not supported on either of the skis. If it is desired to mount the assembled hut 10 on the two skis 32, then the skis 32 can be secured by the connectors 34 to the lower panels 12*b* and 14*b* of the opposite side walls, as shown in FIG. 6*c*, which also shows the side wall comprising the panels 14*a* and 14*b* and the roof comprising the panels 16*a* and 16*b* connected to the opposite side wall and the rear wall of the hut by hasps 37 secured by screws to the plywood panels.

Alternatively, to reduce the possibility of accidents due to the effect of wind on the partially erected hut, the panels may be connected together, to the extent possible, while they remain flat on the ground, and then quickly raised and secured to form the erected hut.

A filler strip 22*b* is then secured by fasteners 38 to the lower edge of the rear wall of the hut, as shown in FIG. 6*d*, to close the gap between the bottom of the rear wall and the ground, and the front wall is secured to the two side walls by four of the fasteners 23, as shown in FIG. 6*e*.

It will be apparent that the hinges of the opposite side walls extend horizontally in the assembled hut 10, whereas the hinges of the front and rear walls extend vertically, so that the four walls thus prevent one another from folding into their collapsed positions.

Figure 5:
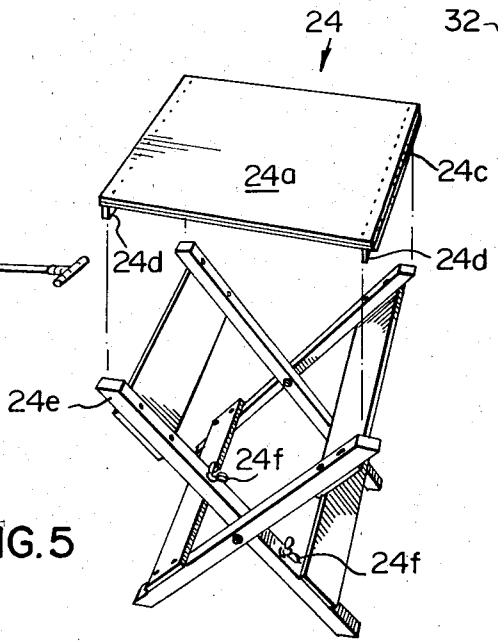
FIG. 5 shows a view in perspective of parts of a collapsible stool.

As shown in FIG. 5, which illustrates one of the stools 24, each stool comprises a pair of square plywood panels 24*a* which are connected together along adjacent edges by a hinge 24*c* and which, when the stool is in use, are folded so as to overlie one another and form a seat. A pair of wood strips 24*d* are provided at the underside of the seat, at opposite edges thereof, for engagement with a pair of pivotally connected support frames 24*e*, so that the stool can be employed in the condition in which it is shown in FIGS. 1 and 6 as a seat during fishing, eating or other periods.

During the assembly of the container 28 shown in FIG. 3, the panels 24*a* are spread apart and secured by the connectors 30 to the opposite side walls of the container 28, and the support frames 24*e* are collapsed and secured by wing nuts 24*f* to the plates 24*a* to ridigify the front and rear walls of the container 28.

By removing the rear wall of the container 28 and tipping up the container 28 into the position in which it is shown in FIG. 6, the container may be employed as a windbreak.

Referring now to FIG. 7, which shows one of a pair of clips 37*a* connecting the roof to the side walls adjacent the roof hinge, clip 37*a* lies flat on the roof panel 16*a* or 16*b* and is secured thereto by a pair of screws 39, and has an arm 37*b* which lies flat against one of the wall panels and retains the latter beneath a marginal edge portion of the roof panel.

FIG. 8 shows in greater detail one of the connectors 34 and, more particularly, shows one of the connectors 34 securing the panel 12*b* to the ski 32.

The connector 34 is in three interengaged parts, which comprise an upper part, an intermediate part and a lower part indicated generally by respective reference numerals 40, 42 and 44.

The upper part 40 comprises a plate 46 secured by screws 48 to the lower marginal portion of the panel 12*b* and a downwardly-open hollow frusto-conical sleeve 50, which is upwardly convergent and which is formed in one piece with the plate 46 by molding synthetic resin material.

The lower part 44 comprises a plate 52 secured by screws 54 to the ski 32, and a post portion 56 formed in one piece with the plate 52 and extending upwardly from the plate 52. The upper portion (not shown) of the post portion 52 comprises a peripheral flat horizontal annular surface and an upwardly convergent frusto-conical portion projecting upwardly from this annular surface and mating by engaging in the sleeve 50 of the connector upper part 40.

The intermediate part 42 comprises a plate 58 which fits beneath and supports the underside of the panel 12*a* and which has a portion which projects laterally outwardly from the panel 12*b* and is formed with a circular opening (not shown) which fits over the upwardly convergent frusto-conical portion of the post portion 56 and is seated on the post portion 56 between the annular surface of the latter and the bottom edge of the sleeve 50.

A flexible strap 60, which is pivotally secured at one end thereof to the post portion 56 by means of a retaining knob 62 and releasably secured at its other end by a retaining knob 64 projecting through an opening in the other end of the strap. The knobs 62 and 64 project from the post portion 56. The strap 60 can be disengaged from the retaining knob 64 and engaged with a retaining knob 66 projecting from the sleeve 50, as shown in broken lines in FIG. 8, for releasably securing together the three parts of the connector 34.

FIG. 9 shows a view in perspective of one of the connectors 23, which is formed as a modified door hinge comprising plates 68 formed with interengaged cylindrical portions 70. To facilitate the interengagement of the cylindrical portions 70, the axial lengths of the portions 70 are decreased, so that spacings or slots 72 are left between these portions 70. The spacings 72 facilitate the insertion of the cylindrical portions between one another as the plates 68 are brought together and, thus, allow for slight inaccuracies or misalignments as the panels of the hut are being assembled.

A pin 74, which extends through the cylindrical portions for securing the two plates 68 together in this manner of a hinge pin, is formed with a laterally projecting handle 76 to facilitate removal of the pin 74 when the hut is being dismantled.

While a preferred embodiment of the invention has been described hereinabove, various possible modifications thereof will be readily apparent to the man skilled in the art and it is therefore to be understood that the invention is not restricted to the features of this embodiment but may be varied within the scope of the appended claims.

I claim:

1. A collapsible hut, comprising:

a plurality of separable sheet-shaped wall and roof components;

means for releasably securing said sheet-shaped wall and a roof components together in a first assembly as the walls and roof of a hut;

means for releasably securing a pair of said sheet-shaped wall components together in a second assembly as a floor and opposite side walls of a container;

ground engagement means for supporting said container for travel over the ground;

said wall and roof components each comprising sheet-shaped panels with longitudinal edges and end edges, and means for connecting said panels to one another along adjacent longitudinal edges of said panels; and means for securing end edges of said panels of each of said components to a longitudinal edge of one of said panels of an adjacent one of said components in said first assembly, so that said panels of each of said components are thereby held in a respective co-planar relationship by an adjacent one of said components.

2. A collapsible hut as claimed in claim 1, further comprising a pair of collapsible seats and means for releasably connecting said seats in said second assembly as front and rear end walls of said container.

3. A collapsible hut as claimed in claim 1, wherein said ground engagement means is releasably securable to said wall components for supporting said first assembly on the ground.

4. A collapsible hut as claimed in claim 1, wherein said ground engagement members comprise a pair of skis, means for securing said skis to said wall components at a pair of locations spaced apart longitudinally of each of said skis and means for releasably and rotatably securing a pair of wheels to said skis between said pairs of locations, whereby said wheels are engageable with the ground and said skis act as suspension springs.

5. A collapsible hut as claimed in claim 1, wherein said wall components comprise a pair of side walls each comprising a pair of rectangular panels and means for hingedly connecting said pair of panels together along longitudinal edges of said panels, whereby each of said pair of panels can be arranged with one panel thereof extending horizontally to form a portion of a bottom of said container in said second assembly and with the other panel thereof extending upright to form a wall of said container.

6. A collapsible hut as claimed in claim 5, wherein said wall components comprise two further walls each comprising a pair of panels and means for hingedly connecting said pair of panels along longitudinal edges thereof, whereby said further walls can be collapsed to lie flat on the bottom of said container and wherein one of said panels of one of said further walls comprises a door.

7. A collapsible hut as claimed in claim 6, wherein said roof components comprise a pair of rectangular roof panels and means hingedly connecting said roof panels along longitudinal edges thereof, whereby said roof panels can be collapsed to lie flat on the bottom of said container.

8. A collapsible hut as claimed in claim 5, further comprising a pair of collapsible seats and means for releasably connecting said seats in said second assembly as front and rear end walls of said container.

9. A collapsible hut as claimed in claim 5, wherein said ground engagement means is releasably securable to said wall components for supporting said first assembly on the ground.

10. A collapsible hut as claimed in claim 5, wherein said ground engagement members comprise a pair of skis, means for securing said skis to said wall components at a pair of locations spaced apart longitudinally of each of said skis and means for releasably and rotatably securing a pair of wheels to said skis between said pairs of locations, whereby said wheels are engageable with the ground and said skis act as suspension springs.

11. A collapsible hut as claimed in claim 1, wherein said panel connecting means comprise hinge means for pivotally connecting together the panels of each of said wall and roof components.

12. A collapsible hut, comprising;

a plurality of sheet-shaped wall and roof components;

means for releasably securing said sheet-shaped wall and roof components together in a first assembly as parts of a hut;

means for releasably securing said sheet-shaped wall components together in a second assembly as parts of a container;

ground engagement means for supporting said container for travel over the ground;

said wall components comprising a pair of side walls each comprising a pair of rectangular panels and means for hingedly connecting said pair of panels together along longitudinal edges of said panels, whereby each of said pair of panels can be arranged with one panel thereof extending horizontally to form a portion of a bottom of said container in said second assembly and with the other panel thereof extending upright to form a wall of said container; and a pair of collapsible seats and means for releasably connecting said seats in said second assembly as front and rear end walls of said container.

* * * * *